United States Patent [19]

Horn

[11] 4,066,518

[45] Jan. 3, 1978

[54] PRODUCTION OF POTASSIUM OR SODIUM STANNATE

[75] Inventor: Richard E. Horn, Pittsburgh, Pa.

[73] Assignee: Pitt Metals and Chemicals, Inc., Pittsburgh, Pa.

[21] Appl. No.: 716,234

[22] Filed: Aug. 20, 1976

[51] Int. Cl.[2] ..... C25B 1/00

[52] U.S. Cl. ..... 204/86; 204/180 P; 423/593

[58] Field of Search ..... 204/86, 94, 180 P; 423/593

[56] References Cited

U.S. PATENT DOCUMENTS

| | | | |
|---|---|---|---|
| 883,589 | 3/1908 | Thirot | 204/86 |
| 3,795,595 | 3/1974 | Wilson | 204/94 |
| 3,907,653 | 9/1975 | Horn | 204/94 |

FOREIGN PATENT DOCUMENTS

| | | | |
|---|---|---|---|
| 298,461 | 6/1929 | United Kingdom | 204/86 |

*Primary Examiner*—T. Tung

*Attorney, Agent, or Firm*—Stanley J. Price, Jr.; John M. Adams

[57] ABSTRACT

Alkali metal stannates are produced in an electrochemical process by dissolving a tin anode in an appropriate alkali metal hydroxide in the anode compartment of an electrodialytic cell. The anode compartment of the electrodialytic cell is separated from a cathode compartment by an anionic or a cationic permselective ion exchange membrane. The tin is dissolved in the anode compartment in the stannous form and after reacting with the alkali metal hydroxide is oxidized to the stannic form to produce the desired alkali metal stannate.

13 Claims, 2 Drawing Figures

PRODUCTION OF POTASSIUM OR SODIUM STANNATE

BACKGROUND OF THE INVENTION

1. Field of the Invention

This invention relates to electrochemically producing alkali metal stannates and, in particular, to an electrochemical process for manufacturing potassium stannate and sodium stannate.

2. Description of the Prior Art

Traditionally, alkali metal stannates have been produced by the chemical reaction of tin hydroxide with an appropriate alkali metal hydroxide or by chemically or electrochemically producing stannic (quadrivalent) tin with the appropriate alkali metal hydroxide to produce the desired alkali metal stannate. These known processes, however, pose certain insurmountable problems that predicate the need for an improved process for producing needed alkali metal stannates for use in a variety of commercial applications, including metal plating.

In the first of the above-mentioned processes, the production of the alkali metal stannate generally proceeds by chemically reacting tin hydroxide in solution with an excess of the appropriate alkali metal hydroxide in a heated reaction vessel. When the desired reaction is completed, the solution is cooled and filtered, and the alkali metal stannate is recovered by crystallization. However, in recent years, the amount of available tin hydroxide usable for this method of manufacturing has diminished drastically; and it is, therefore, impractical or not possible to use this method on a large scale to produce the required quantities of alkali metal stannates that are in commercial demand.

In either of the latter of the above-mentioned processes, other difficulties are posed by the inherent necessity of producing stannic (quadrivalent) tin by chemical reaction with the appropriate alkali metal hydroxide to produce the desired alkali metal stannate. When proceeding chemically, the process involves reacting tin with an appropriate alkali metal hydroxide in the presence of an oxidizing agent, such as sodium nitrate, sodium nitrite or both. An oxidizing agent is necessary in this process as tin will not dissolve readily in alkali solutions. Moreover, the addition of a substantial amount of heat over a considerable amount of time is necessitated in order to promote oxidation and reaction. Also, it is necessary for practical reasons to keep the solution relatively dilute and to maintain an excess of both the alkali metal hydroxide and the oxidizing agent in the reaction solution.

The reaction proceeds according to the following general equation:

$$Sn + NaOH + NaNO_3 + 4H_2O \rightarrow Na_2Sn(OH)_6 + NH_3 + O_2$$

When the desired reaction is completed, the dilute solution must then be concentrated at the expense of the use of a substantial additional amount of heat; and the alkali metal stannate is thereafter recovered by crystallization. In such a process, it will be apparent that there is required the expenditure of both an oxidizing agent and a substantial amount of heat for the oxidation of the tin for reaction and for concentration of the solution. Moreover, the process requires for its effective utilization either the use of scrap tin plate, which is becoming increasingly scarce, or prilled, mossy or otherwise finely comminuted tin. The reason for the use of scrap tin plate or prilled, mossy or otherwise finely comminuted tin is that, even with an oxidizing agent, the rate of dissolution of the tin is very slow and large surface area is, therefore, needed in order for the reaction to occur at any commercially acceptable rate.

Similarly, it is known to produce alkali metal stannates electrochemically by anodically dissolving stannic (quadrivalent) tin into an alkali metal hydroxide such that by direct reaction an alkali metal stannate is produced. However, such a process is extremely sensitive. It requires very precise control in order to prevent the tin from again plating out. Precise control of the oxygen necessary for filming the anode is also required so as to avoid forming an oxide film on the anode which will cause the anode to stop dissolving. Moreover, as will be seen hereinafter, the electrical power required in such a process is substantial, thereby not only increasing the cost of the end product but also utilizing substantial energy at the present time when energy conservation is of such great importance.

SUMMARY OF THE INVENTION

In accordance with the present invention, there is provided an improved, more efficient, less costly, less energy consuming, easily controllable process for producing alkali metal stannates at a higher commercial rate than was heretofor possible by prior art methods. In particular, the process of this invention proceeds by anodically dissolving stannous tin ions into an alkali metal electrolyte to form an alkali metal stannite, simultaneously preventing the stannite from migrating from the anode to a cathode by interposing therebetween a permselective ion exchange membrane, oxidizing the alkali metal stannite to an alkali metal stannate and recovering the alkali metal stannate from the electrolyte.

Although the use of electrodialytic cells, per se, is known, as shown in U.S. Pat. No. 3,907,653, and the production of stannous tin cations in an electrodialytic cell is also known in other processes, as shown in U.S. Pat. No. 3,795,595, it was not until the advent of the present invention that such an apparatus and preliminary process step was conceived as a desirable adjunct to producing alkali metal stannates in the manner hereinafter disclosed.

DESCRIPTION OF THE PREFERRED EMBODIMENTS

Figure 1:
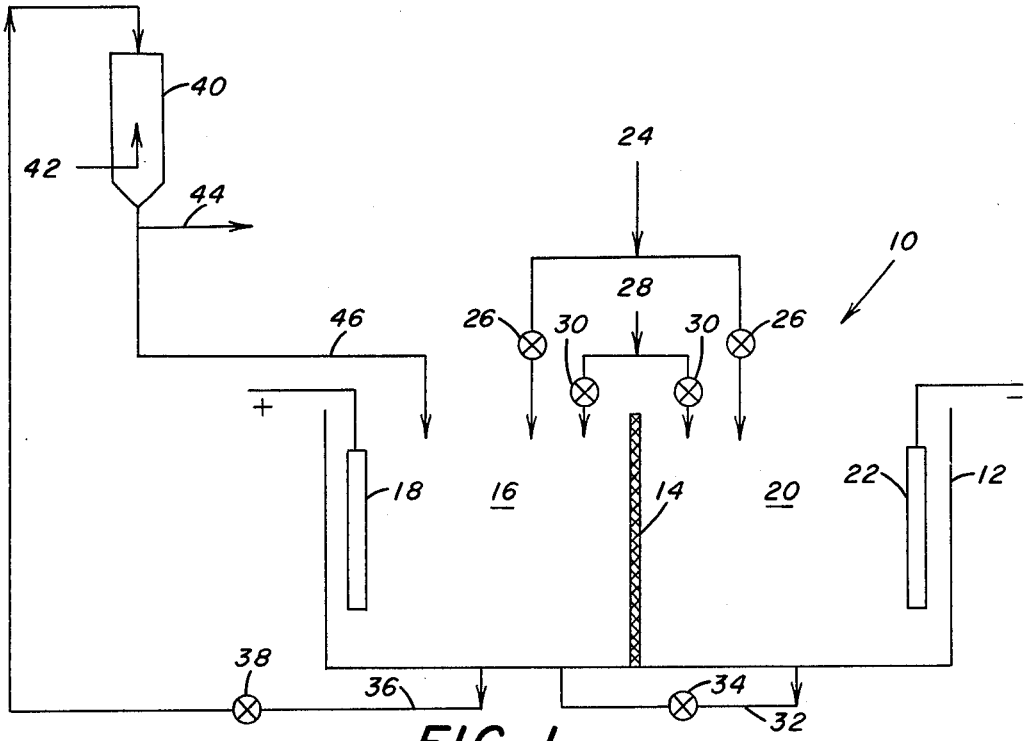
FIG. 1 is a schematic flow diagram illustrating one preferred method of producing alkali metal stannate in accordance with this invention.

Referring to FIG. 1 of the drawings, there is illustrated an electrodialytic cell 10 comprised of a suitable tank or vessel 12 which is separated into two discrete compartments by a permselective ion exchange membrane 14. The anode compartment 16 contains a tin anode 18, and the cathode compartment 20 contains a cathode 22 of any suitable material that will not react with the electrolyte to be employed. The anode 18 and the cathode 22 are further arranged to be operatively connected to the positive and negative terminals, respectively, of a source of D.C. power (not shown).

In communication with each of the compartments 16 and 20 there is provided by any suitable means a supply of electrolyte material from a source 24 via suitable electrolyte metering devices 26. Similarly, each compartment is or may be placed in communication by any suitable means with a supply of water from a source 28 via suitable water metering devices 30. Also, for reasons that will become more apparent hereinafter, cell 10 may desirably be provided with a suitable means of communication 32 between the cathode compartment 20 and the anode compartment 16 via a suitable electrolyte solution metering device 34.

Leading from the anode compartment 16, a suitable means of communication 36 is illustrated in the drawing to convey reacted solution therefrom via a reacted solution metering device 38 to an oxidizing chamber, such as a scrubbing tower 40. As is further illustrated, the scrubbing tower 40 is provided with suitable means for introducing therein a source of oxygen, such as a source of air 42, preferably in counterflow with the flow of reacted solution through the tower. After passing through the scrubbing tower, a portion of the oxidized solution is removed via line 44; and the residuum solution is returned via line 46 to the anode compartment 16.

Having generally delineated a preferred processing arrangement, a complete understanding of the invention will now become apparent from the example and discussion that follows.

EXAMPLE 1

An electrodialytic cell was prepared using a tin anode 18, a stainless steel cathode 22 and an anionic permselective ion exchange membrane 14. The anionic permselective membrane 14 used was a commercially available membrane manufactured by the Ionac Chemical Company of Burmingham, New Jersey, and designated "MA-3475". A potassium hydroxide electrolyte solution was prepared in anode compartment 16 and cathode compartment 18 by means of potassium hydroxide being introduced from source 24 and water being introduced from source 28. The initial concentration of the potassium hydroxide in both compartments was 120 grams per liter.

A source of D.C. power was connected between anode 18 and cathode 22 and was adjusted to 1.44 volts at 5.0 amps. After a brief period of operation, the reacted electrolyte (anolyte) in the anode compartment contained 22 grams per liter of free potassium hydroxide and 379 grams per liter of potassium stannite containing therein 150 grams per liter of stannous (bivalent) tin. While maintaining the anode compartment at approximately the above level of free potassium hydroxide by the addition thereto of potassium hydroxide and water, the reacted electrolyte (anolyte) was passed through a 24-inch scrubbing tower 40 at a liquid flow rate of 0.2 gallons per minute. A flow of air was passed through the scrubbing tower countercurrent to the flow of reacted electrolyte (anolyte) and immediately oxidized the stannous (bivalent) tin to stannic (quadrivalent) tin to produce potassium stannate.

Data and results in a 50 hour run are shown in Table 1.

TABLE 1

| Time | Amp-Hrs. | Gms. Sn Produced | $Sn^{+2}$ Corrosion Efficiency | Gm/l Free KOH |
|---|---|---|---|---|
| 0 | — | 150 gm/l | — | 22 gm/l |
| 10 hrs. | 50 | 109.8 gms. | 99.8% | 20 gm/l |
| 20 hrs. | 100 | 226.0 gms. | 105.6% | 20 gm/l |
| 30 hrs. | 150 | 337.7 gms. | 101.5% | 23 gm/l |
| 40 hrs. | 200 | 450.5 gms. | 102.5% | 21 gm/l |
| 50 hrs. | 250 | 562.1 gms. | 101.4% | 21 gm/l |

During the total time of the operation of electrodialytic cell 10, no gassing occurred in the anode compartment due to the low voltage impressed across the cell, and there was no detectable tin in the catholyte or in the cathode compartment. The stannous (bivalent) tin at any given point in time was determined to be 0.02 grams per liter, and the stannic (quadrivalent) tin produced was determined to be 2.20 grams per amp-hour.

Figure 2:
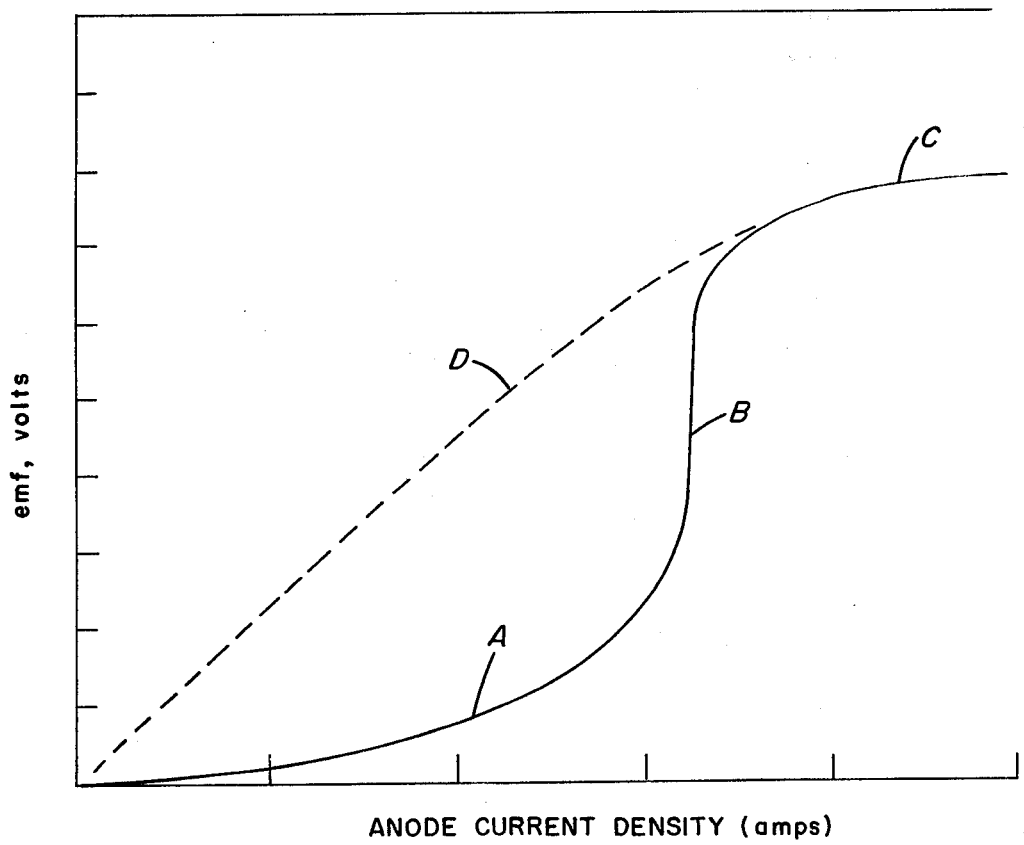
FIG. 2 is a graphical representation of voltages versus current consumption in the conversion of tin to a stannite and to a stannate.

In FIG. 2 the voltage and current required to dissolve tin in an alkaline bath as either the bivalent (stannite) or the quadrivalent (stannate) form is illustrated graphically. The portion of the curve designated by the letter A indicates the anode is dissolving as stannite. The portion of the curve indicated by the letter B is a transition zone where the sharp increase in voltage indicates the tin is now dissolving as a stannate. If the current density is maintained at B or increased as indicated by the letter C, the tin anode becomes passive and behaves as an insoluble anode. If the current density reaches the upper portion of part B of the curve and is then decreased, the current voltage curve will follow the dash line D, and the tin dissolves as stannate. It will be observed, however, from the curve that substantially more energy is required to form a stannate from the tin than to form a stannite. The graphical representation of FIG. 2 clearly illustrates if the current density is maintained below a preselected value the tin will dissolve in the stannite form.

In contradistinction to employing a process wherein stannic (quadrivalent) tin is dissolved from anode 18 and directly reacted with a potassium hydroxide electrolyte, the process of this invention requires approximately one half the voltage and amperage to produce the same dissolution of tin. Accordingly, the process of this invention is substantially less power consuming.

With regard to the permselective membrane used, it is preferred to use an anionic membrane in the practice of this invention. However, it will be understood that a cationic membrane can be substituted for the anionic membrane. The only change in the process would involve the additional step of metering potassium hydroxide via line 32 and metering device 34 from the cathode compartment back to the anode compartment. It will also be recognized that this process will work in an identical manner using sodium hydroxide as the electrolyte to produce sodium stannate.

A further alternative process step for use with this invention is to blow air by conventional means (not shown) through the electrolyte in the anode compartment, while anodically dissolving the tin in stannous form. In this manner, the tin in stannous form will be oxidized to the stannic form in the anode compartment. Such a process step can be used in addition to or in lieu of the step of oxidizing the tin in scrubbing tower 40. Recovery of the alkali metal stannate produced can proceed in any conventionally known manner.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. An electrochemical process for the manufacture of alkali metal stannates comprising, anodically dissolving stannous tin into an alkali metal electrolyte to form an alkali metal stannite, simultaneously preventing the stannite from migrating from the anode to the cathode by interposing therebetween a permselective ion exchange membrane, oxidizing said alkali metal stannite with an oxygen containing gas to an alkali metal stannate, and recovering said alkali metal stannate from said electrolyte.

2. An electrochemical process according to claim 1 wherein the alkali metal is potassium.

3. An electrochemical process according to claim 1 wherein the alkali metal is sodium.

4. An electrochemical process according to claim 1 wherein the electrolyte is potassium hydroxide.

5. An electrochemical process according to claim 4 wherein the membrane is an anionic permselective membrane.

6. An electrochemical process according to claim 5 wherein oxidation is accomplished by passing said alkali metal stannite through a scrubbing tower and subjecting said alkali metal stannite to an oxygen containing gas.

7. An electrochemical process according to claim 4 wherein the membrane is a cationic permselective membrane.

8. An electrochemical process according to claim 7 wherein oxidation is accomplished by passing said alkali metal stannite through a scrubbing tower and subjecting said alkali metal stannite to an oxygen containing gas.

9. An electrochemical process according to claim 1 wherein the electrolyte is sodium hydroxide.

10. An electrochemical process according to claim 9 wherein the membrane is an anionic permselective membrane.

11. An electrochemical process according to claim 10 wherein oxidation is accomplished by passing said alkali metal stannite through a scrubbing tower and subjecting said alkali metal stannite to an oxygen containing gas.

12. An electrochemical process according to claim 9 wherein the membrane is an cationic permselective membrane.

13. An electrochemical process according to claim 12, wherein oxidation is accomplished by passing said alkali metal stannite through a scrubbing tower and subjecting said alkali metal stannite to an oxygen containing gas.

* * * * *